US011796280B2

(12) United States Patent
Pearce

(10) Patent No.: US 11,796,280 B2
(45) Date of Patent: Oct. 24, 2023

(54) PROJECTILE LOADER HAVING STREAMLINED EXTERNAL BODY AND INTERNAL OPENING MECHANISM

(71) Applicant: KORE OUTDOOR (US), INC., Fort Wayne, IN (US)

(72) Inventor: Mark Roland Pearce, Lindenwold, NJ (US)

(73) Assignee: KORE OUTDOOR (US), INC., Fort Wayne, IN (US)

( * ) Notice: Subject to any disclaimer, the term of this patent is extended or adjusted under 35 U.S.C. 154(b) by 0 days.

(21) Appl. No.: 17/104,533

(22) Filed: Nov. 25, 2020

(65) Prior Publication Data

US 2021/0156641 A1 May 27, 2021

Related U.S. Application Data

(60) Provisional application No. 62/940,676, filed on Nov. 26, 2019.

(51) Int. Cl.

| | |
|---|---|
| ***F41B 11/00*** | (2013.01) |
| ***F41B 11/53*** | (2013.01) |
| ***F41B 11/52*** | (2013.01) |

(52) U.S. Cl.

CPC ..... *F41B 11/53* (2013.01); *F41B 11/52* (2013.01)

(58) Field of Classification Search

CPC ..... F41B 11/52; F41B 11/53; B65D 11/18; B65D 43/16; B65D 43/163; B65D 11/873; B65D 11/88

See application file for complete search history.

(56) References Cited

U.S. PATENT DOCUMENTS

| | | | | |
|---|---|---|---|---|
| 5,166,457 | A | 11/1992 | Lorenzetti | |
| 8,047,191 | B2 | 11/2011 | Christopher et al. | |
| 8,235,030 | B2 | 8/2012 | Kaakkola et al. | |
| 8,387,607 | B2 | 3/2013 | Christopher et al. | |
| 8,746,225 | B2 | 6/2014 | Christopher et al. | |
| 8,857,658 | B2 * | 10/2014 | Lin | B65D 43/164 16/232 |
| 8,985,378 | B2 * | 3/2015 | Wan | A45D 33/006 220/525 |
| RE45,490 | E | 4/2015 | Italia et al. | |
| 9,500,435 | B2 * | 11/2016 | Tseng | F41B 11/53 |
| 9,733,042 | B2 * | 8/2017 | Yuen | F41B 11/53 |

(Continued)

FOREIGN PATENT DOCUMENTS

| | | |
|---|---|---|
| DE | 876370 | 5/1953 |
| DE | 2035097 | 1/1972 |

(Continued)

OTHER PUBLICATIONS

WARPIG—World And Regional Paintball Information Guide, http://www.warpig.com/paintball/technical/loaders/halo/index.shtml, warpig.com, Odyssey Readies Halo for Production, By Bill Mills, Jun. 2001, pp. 1 to 6.

(Continued)

*Primary Examiner* — John A Ricci
(74) *Attorney, Agent, or Firm* — Volpe Koenig

(57) ABSTRACT

A projectile loader is provided having a body split into two portions attached by a hinge, wherein a release mechanism for separating the two portions is located internally of the loader body, accessed via a top opening.

19 Claims, 10 Drawing Sheets

(56) References Cited

U.S. PATENT DOCUMENTS

| | | | | |
|---|---|---|---|---|
| 9,857,140 | B2 | 1/2018 | Italia | |
| 9,857,141 | B2 | 1/2018 | Spurlock | |
| 10,502,520 | B2 | 12/2019 | Spurlock | |
| 2002/0020402 | A1 | 2/2002 | Kotsiopoulos | |
| 2008/0047536 | A1 | 2/2008 | Chen | |
| 2011/0073092 | A1* | 3/2011 | Yeh | F41B 11/53 124/49 |
| 2012/0103316 | A1* | 5/2012 | Kaakkola | F41B 11/57 124/51.1 |
| 2013/0015098 | A1* | 1/2013 | Chen | A45D 33/008 206/581 |
| 2013/0220293 | A1* | 8/2013 | Kaakkola | F41B 11/53 124/51.1 |

FOREIGN PATENT DOCUMENTS

| | | |
|---|---|---|
| DE | 3721527 | 1/1989 |
| DE | 4343870 | 6/1994 |
| DE | 4343871 | 6/1995 |
| DE | 19922589 | 12/2000 |
| EP | 0075970 | 4/1983 |
| EP | 1054228 | 11/2000 |
| EP | 1653189 | 5/2006 |
| FR | 921527 | 5/1947 |
| GB | 470201 | 8/1937 |
| GB | 551077 | 2/1943 |
| GB | 2322438 | 8/1998 |
| JP | 1179898 | 7/1989 |
| JP | 6-325233 | 11/1994 |
| TW | M255391 | 1/2005 |
| WO | 98/13660 | 4/1998 |
| WO | 01/44745 | 6/2001 |
| WO | 02/42708 | 5/2002 |
| WO | 03/087698 | 10/2003 |
| WO | 07/033309 | 3/2007 |
| WO | 07/035601 | 3/2007 |
| WO | 07/044546 | 4/2007 |
| WO | 07/044822 | 4/2007 |
| WO | 07/098554 | 9/2007 |
| WO | 08/104061 | 4/2008 |
| WO | 09/009748 | 1/2009 |
| WO | 2009/015393 | 1/2009 |

OTHER PUBLICATIONS

WARPIG—World And Regional Paintball Information Guide, http://www.warpig.com/paintball/technical/loaders/halo/review.shtml, warpig.com, Odyssey Halo By Bill Mills, Dec. 2001, pp. 1 to 7.

Odyssey Halo B Paintball Hopper Review, http://www.paintball-gun-review.com/hopper-reviews/odyssey-halo-b . . . , Paintball Gun Review, Odyssey Halo B Paintball Hopper Review, 2004 Paintball-Gun-Review.com, pp. 1 to 3.

www.ODYSSEYPAINTBALL.com, http://web.archive.org/web/20030205112543/http://www.odysseypain . . . , Odyssey Paintball Products, Understanding Halo B, pp. 1 to 3.

WARPIG—World And Regional Paintball Information Guide, http://www.warpig.com/paintball/technical/loaders/evlution/evlution . . . eVLution 2 Sneak Preview, by Bill Mills, Aug. 2001, p. 1 to 4.

WARPIG—World And Regional Paintball Information Guide, http://www.warpig.com/paintball/technical/loaders/evlution/index.shtml Brass Eagle's eVLution Loader, by Bill Mills, Aug. 2000, pp. 1 to 7.

WARPIG—World And Regional Paintball Information Guide, http://www.warpig.com/paintball/technical/labs/revytimes/index/shtml WARPIG Ballistic Labs Report: Revolution Response Times, by Bill Mills, copyright 1992-2010, pp. 1 to 4.

Virtue Spire Paintball Loader Manual, Available at: https://pbmanuals.com/downloads/775_Virtue_Virtue_Spire_Hopper_Manual_ENG.pdf (2013).

Virtue Spire III Paintball Loader Manual, Available at: https://www.manualslib.com/manual/1709739/Virtue-Spire-III.html (2012).

Valken V-Max Plus V4 Paintball Loader Owners Manual, Available at: https://valken-weblinc.netdna-ssl.com/media/W1siZilsljlwMjAvMDkvMjkvMTEvMjEvMjAvZGQyYmlxY2EtYTUxMl00NTU2LWE5NzEtMmlxM2NiNmYyMmQ5L1ZtYXhQbHVzLU1hbnVhbC12NC5wZGYiXV0/VmaxPlus-Manual-v4.pdf?sha=e962915fc26eb905 (2015).

Valken V-Max Manual, Available at: https://paintball.skiep.pl/public/assets/images/instrukcje/Valken%20V-max%20manual.pdf (2011).

Valken V-Max Plus Paintball Loader Owners Manual (2014).

WARPIG—World and Regional Paintball Information Guide http://www.warpig.comipaintballitechniceloadersilineup WARPIG Ballistic Labs Loader Speed Comparison, by Bill Mills, Sep. 2001, 8 pages.

* cited by examiner

PROJECTILE LOADER HAVING STREAMLINED EXTERNAL BODY AND INTERNAL OPENING MECHANISM

INCORPORATION BY REFERENCE

The following document is incorporated in its entirety by reference as if fully set forth herein: U.S. Provisional Patent Application 62/940,676, filed Nov. 26, 2019.

FIELD OF THE INVENTION

This invention relates to the field of projectile loaders, and more particularly, to a projectile loader having an internal mechanism for releasing a hinged loader body for a streamlined external appearance.

BACKGROUND

Projectile loaders (otherwise known and used interchangeably herein as hoppers, magazines, projectile loaders, or loaders) generally connect to projectile markers (compressed gas guns) and feed projectiles into the marker. These projectile loaders store projectiles and have an outlet or exit tube (outfeed tube or neck). The outlet tube is connected to an inlet tube (or feed neck) of the projectile marker, which is in communication with the breech of the marker. During the normal operation, projectiles dropped through the outlet of the loader from a projectile stack within the outlet tube and gun inlet tube. When the projectile at the bottom of the stack is dropped into the firing chamber of the projectile marker, it is replaced at the top of the stack from the supply of projectiles remaining in the loader housing, thereby replenishing the stack. Thus, the loaders act to hold and feed projectile projectiles into the breach of a projectile marker, so that the projectiles can be fired from the marker.

Many loaders contain agitators or feed systems to mix, propel, or otherwise move projectiles in the loader. This mixing is performed by an impeller, projection, drive cone, agitator, paddle, arm, fin, carrier, or any other suitable mechanism, such as those shown and described in U.S. patent application Ser. No. 12/171,956 (U.S. Patent Application Publication No. 2009/0133680) and U.S. Pat. Nos. 6,213,110; 6,502,567; 5,947,100; 5,791,325; 5,954,042; 6,109,252; 6,889,680; and 6,792,933; the entire contents of all of which are incorporated by reference herein as if fully set forth. In "gravity feed" hoppers, the hopper has no moving parts, and projectiles fall into an outfeed tube by gravity. In "agitating" loaders, an agitator mixes projectiles so that no jams occur at the exit opening of the outlet tube. In "force feed" or "active feed" projectile loaders, the agitator or feeder (drive cone, carrier, paddle, or any other force feed drive system) forces projectiles through the exit tube. As the firing rates of projectile markers have increased, active feed loaders have become extremely popular due to their ability to ensure the proper feeding of projectiles and sustain the feed rates necessary to support today's markers.

Modern loaders utilize projections, paddles, arms, carriers, drive cones, or other agitators to mix or advance projectiles. These agitators are operated by motors which are often controlled by an electronic control circuit. These control circuits may utilize microprocessors in conjunction with at least one sensor configured to detect any number of parameters, including the firing of a projectile from the marker or the occurrence of a jam. These components are typically powered by a D.C. power source, such as a battery.

It is often necessary for, by way of example, a projectile sport player to access the interior components of a projectile loader, for example to fix a jam. A player may also need to access components inside the body of the projectile loader, such as the agitators, control circuits, power supplies, sensors, and drive mechanisms.

Moreover, if a projectile breaks inside a projectile loader, there must be a convenient and efficient way to open the body and clean the paint or dye from the inside of the projectile hopper, without having to fully disassemble the loader.

Virtually all of the known solutions to the issue of accessing a projectile loader have focused on typical external release mechanisms such as push-buttons or latches. These have the drawback of being prone to damage, dirt, and debris, along with the possibility of accidental actuation during activity. Likewise, such external components add visual weight that detracts from the sleek aesthetic that players desire.

Thus, there is the need for an openable projectile loader and feed mechanism that overcomes the aforementioned problems and provides easy release/open of the loader while maintaining a uniform outer appearance.

SUMMARY

The present invention provides for an openable projectile loader comprising a body defining an interior area housing internal components and an internally accessible release mechanism. The body has a generally smooth outer surface, with few or no external protrusions, recesses or features. The body is split into a first portion and a second portion, the first portion is attached to the second portion by a hinge, and the first portion and second portion are moveable relative to each other via the hinge between an open position and a closed position. The release mechanism is configured to selectively permit detaching the first portion and the second portion, wherein the release mechanism is located in the interior area of the body.

The projectile loader has an opening for stocking the projectile loader, wherein the release mechanism is accessible via the opening.

In another embodiment, the actuator for the release mechanism can be located proximate to the front of the projectile loader and the opening being located proximate to the rear of the projectile loader.

In another embodiment, the release mechanism actuator can be located proximate to the hinge.

In another embodiment, the first portion and the second portion of the projectile loader can be essentially the same size.

In another embodiment, the present invention provides a moveable feeder housed within the interior of the projectile loader body.

In another embodiment, the present invention provides a feed mechanism comprising a moveable feeder and a motor housed within the interior of the projectile loader body, and the feed mechanism is configured to be at least partially removable from the projectile loader body when body is in the open opposition.

In another embodiment, the first portion and the second portion of the projectile loader are removably engaged.

In another embodiment, the present invention provides the hinge being spring-biased to an open position.

In another embodiment, the present invention provides the hinge being spring-biased to a closed position.

In another embodiment, the present invention provides a projectile loader with the body being split generally vertically along the length of the body such that the first and second portions are respectively a first side portion and a second side portion.

DETAILED DESCRIPTION

Figure 1:
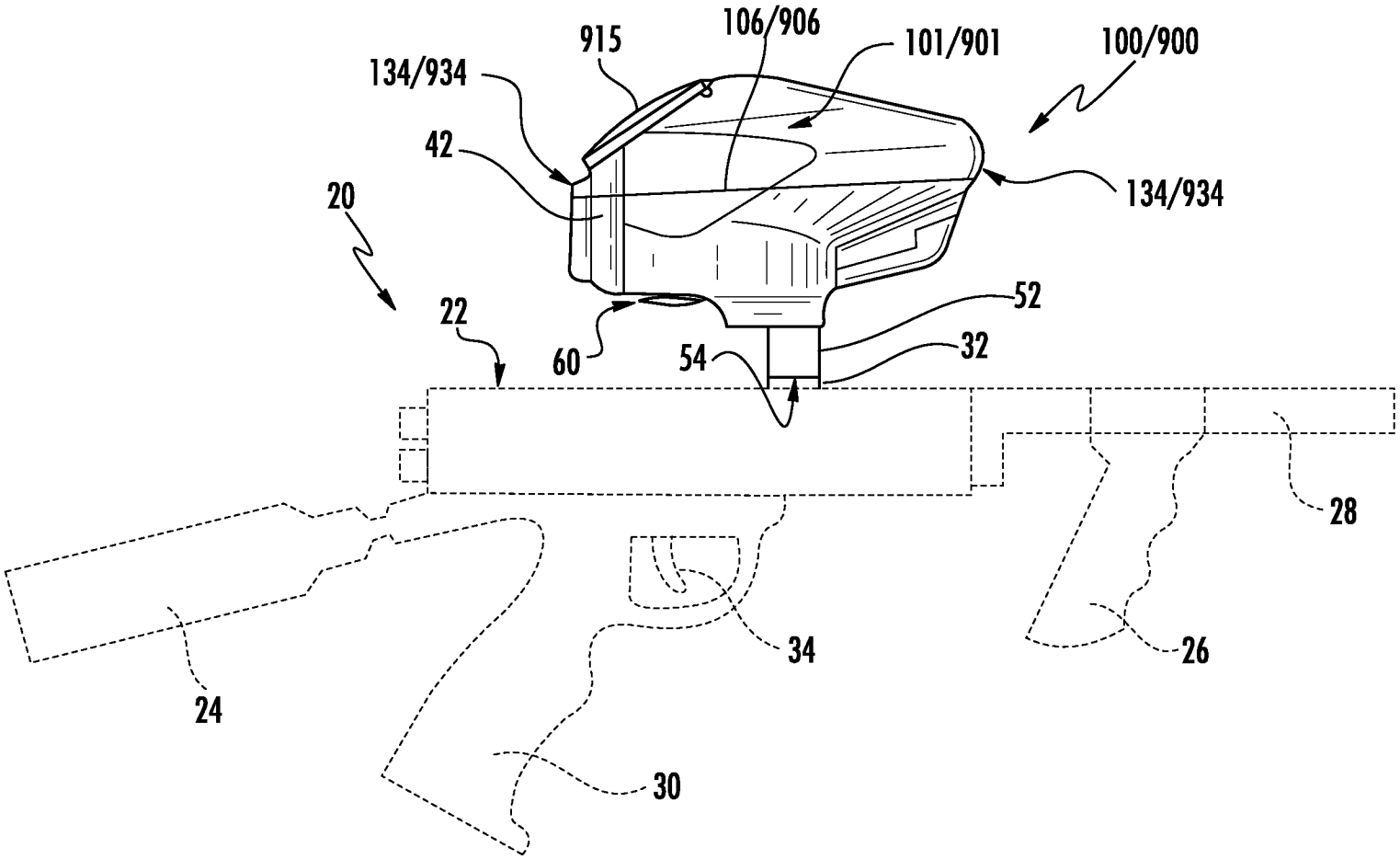
FIG. 1 is a side elevational view of an exemplary projectile loader attached to a projectile marker (gun) shown in broken lines.

FIG. 1 is a side elevational view of a loader 100 or 900 operatively attached to a representative projectile marker (gun) 20, illustrated in broken lines. The projectile marker 20 includes a main body 22, a compressed gas cylinder 24, a front handgrip 26, a barrel 28, and a rear handgrip 30. The projectile marker 20 also includes an inlet tube 32 leading to a firing chamber in the interior of the main body and a trigger 34. The front handgrip 26 projects downwardly from the barrel 28 and provides an area for gripping by an operator of the projectile marker 20. The compressed gas cylinder 24 is typically secured to a rear portion of the projectile marker 20. The compressed gas cylinder 24 normally contains CO2, although any compressible gas may be used.

A projectile loader or "loader" 100/900, such as one which may be used for the present invention, includes a body 101/901 which houses an open interior area 138/938, a rear end 134/934, and a front end or front portion 132/932. The loader 100/900 may include a portion 42 having control circuitry or electronics, which may include a microprocessor, for controlling various operating parameters of the projectile loader. The lower portion of the projectile loader leads to an outfeed, exit tube, or feed neck 112/912, which communicates with the infeed tube 32 to supply projectiles to the projectile marker 20. A manual drive assistance actuator 60 may be provided to turn the feeder inside the projectile loader body 101/901.

In operating the projectile marker 20, the trigger 34 is squeezed, thereby actuating the compressed gas cylinder 24 to release bursts of compressed gas. The bursts of gas are used to fire projectiles outwardly through the barrel 28. The projectiles are continually fed by the loader 100/900 through the inlet tube 32 to the firing chamber.

Some projectile loaders or feeders are described in detail in U.S. Pat. No. 6,213,110 ("Rapid Feed Projectile Loader"), U.S. Pat. No. 6,502,567 ("Rapid Feed Projectile Loader With Pivotable Deflector"), U.S. Pat. No. 6,701,907 ("Spring Loaded Feed Mechanism For Projectile Loader"), and U.S. Pat. No. 6,792,933 ("Drive Cone For Projectile Loader"), the entire contents of which are each incorporated by reference herein as if fully set forth.

Figure 2:
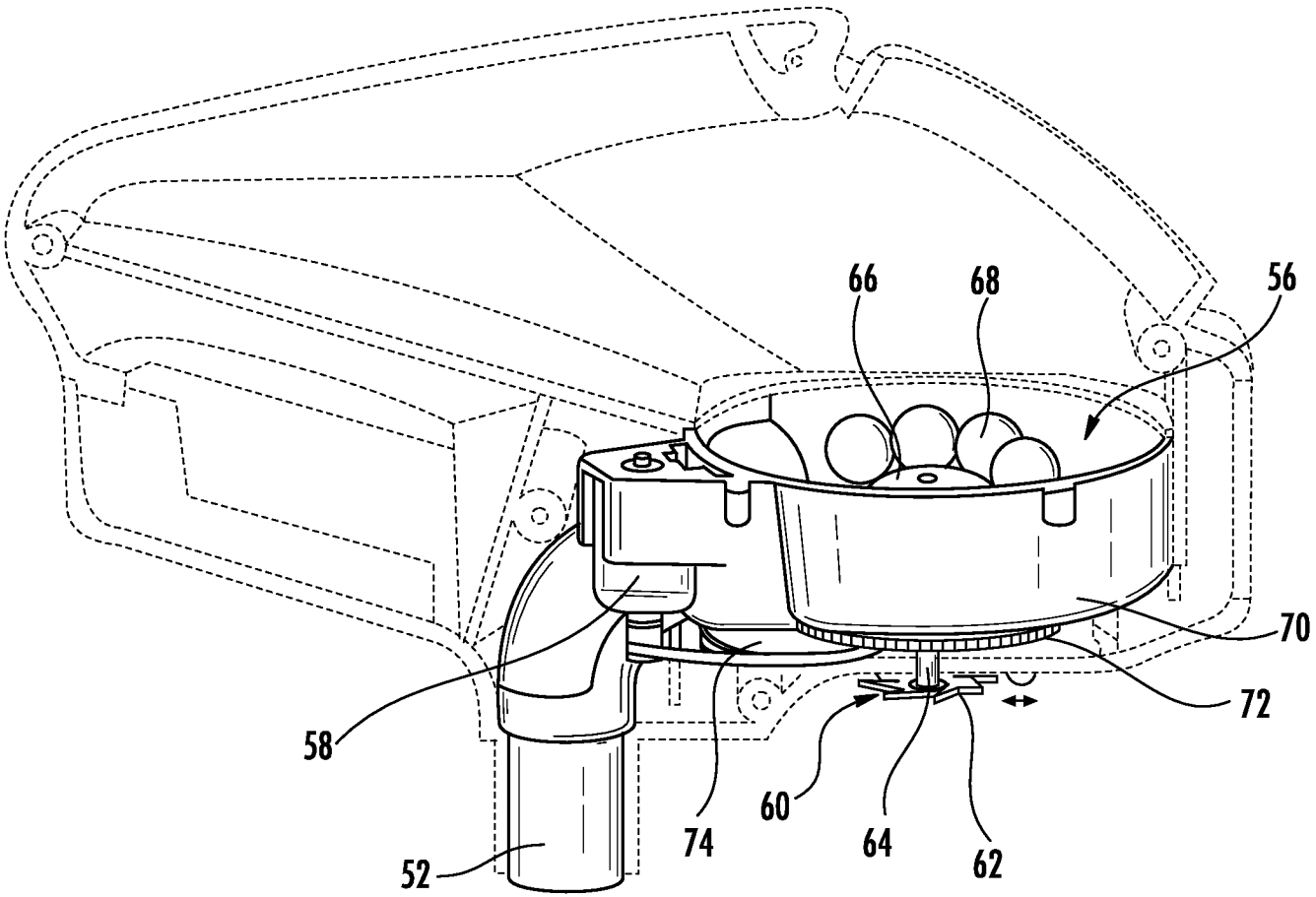
FIG. 2 is a side partial cutaway of a projectile loader, showing the internal feed mechanism, with a portion of the body shown in phantom.
Figure 3:
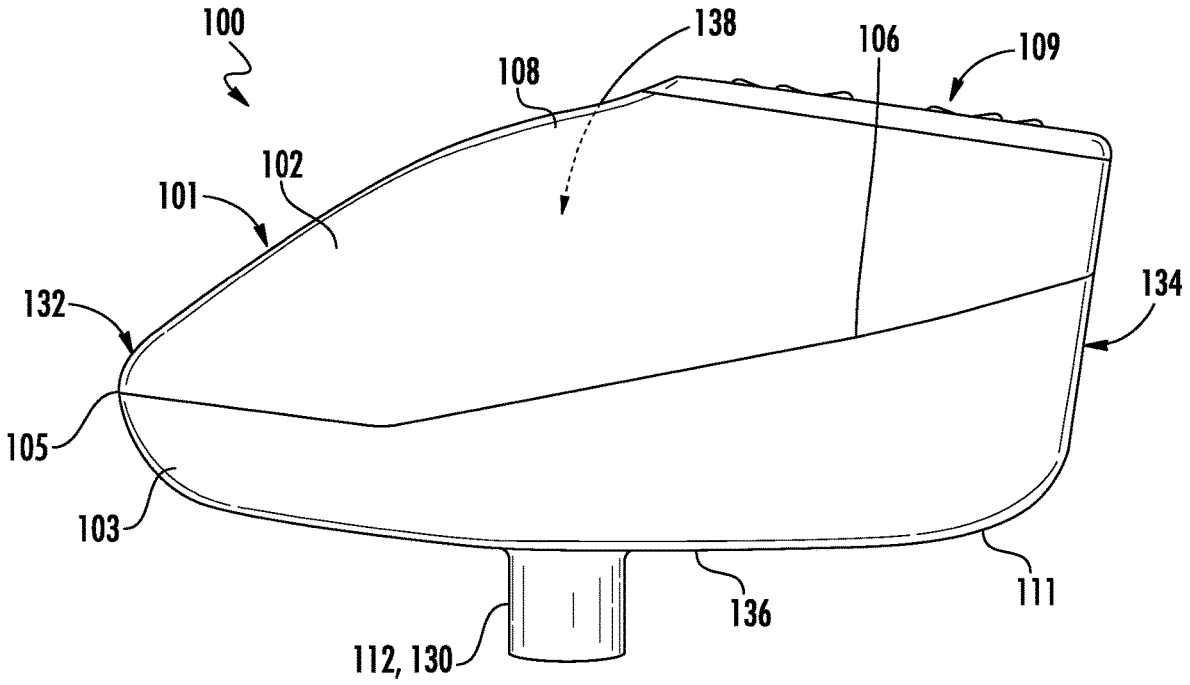
FIG. 3 is a side perspective view of a projectile loader having a hinged body according to an embodiment of the present invention.
Figure 4:
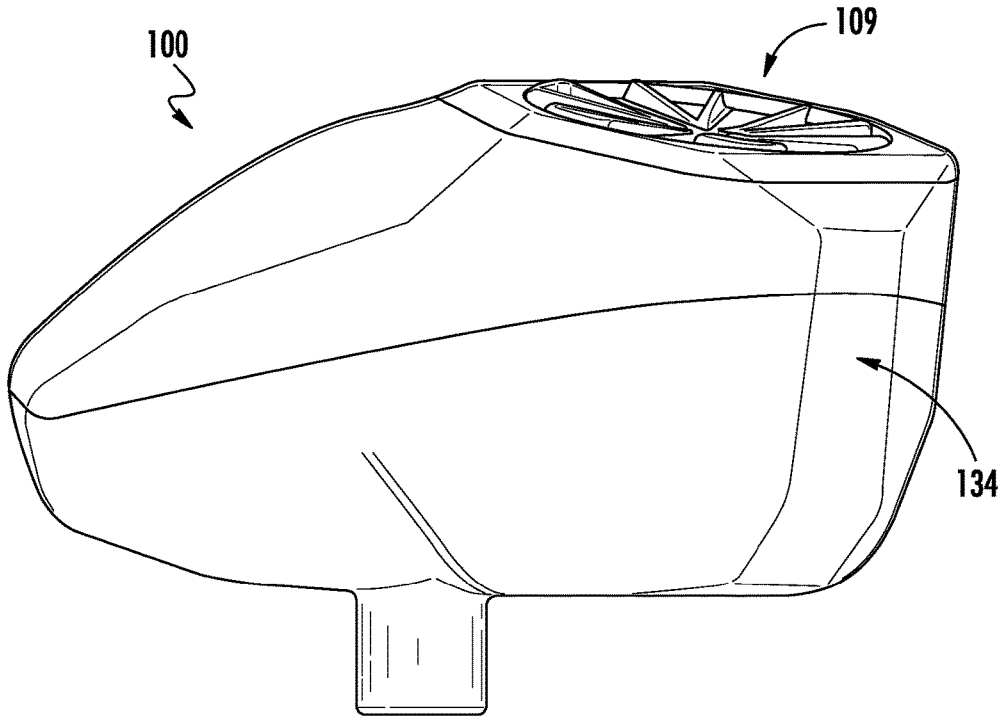
FIG. 4 is a rear perspective view of the projectile loader according to FIG. 3.

As shown in FIG. 2, a feed mechanism 56 is generally used to drive, feed, move, or urge the projectiles toward the exit tube 52 and into the inlet tube 32 of the projectile marker 20. The feed mechanism 56 preferably includes a feeder 66 positioned within the projectile loader body and coupled to a drive shaft, with the drive shaft 64 coupled to a motor 58 and gear system 72, 74, to drive projectiles 68 toward the exit tube 52. While an illustrative feed mechanism 66 is shown, various other components may be substituted for driving projectiles into the projectile marker 20. A catch cup portion 70 may house the feeder 66, and act as a reservoir or well where the projectiles 68 are held for feeding.

A variety of feed mechanisms 56 and feeders 66 can be used in the present invention, including an impeller, drive cone, paddle wheel, fin, carrier, or other device which can direct or otherwise force or urge projectiles into the exit tube 52. By way of example and not limitation, a drive cone may be used with a plurality of fins which extend in a radial direction from the central part of the drive cone. It is appreciated that the feeder may include recesses or pockets within which the projectiles sit as they are shuttled toward the exit tube 52. The feeder 66 may be mounted on a drive shaft 64. The drive shaft 64 is connected to the motor 58 to rotate about a central axis. As the motor 58 operates, the feeder 66 moves, pushing balls into exit tube 52.

While the feed mechanism 56 is shown, it is appreciated that a projectile loader 100 according to the present invention could be formed without an interior moving feed mechanism or feeder, and work as a gravity fed hopper.

Figure 6:
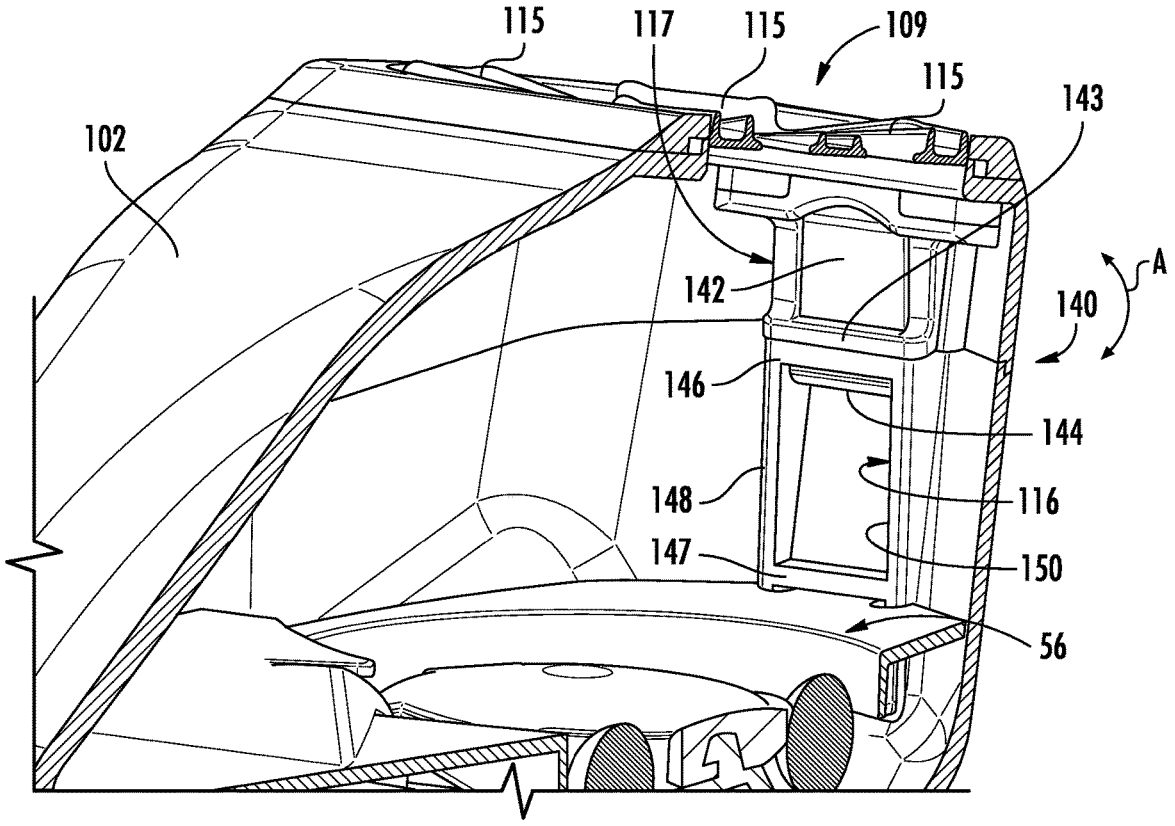
FIG. 6 is a partial cutaway of the projectile loader according to FIG. 3.
Figure 7:
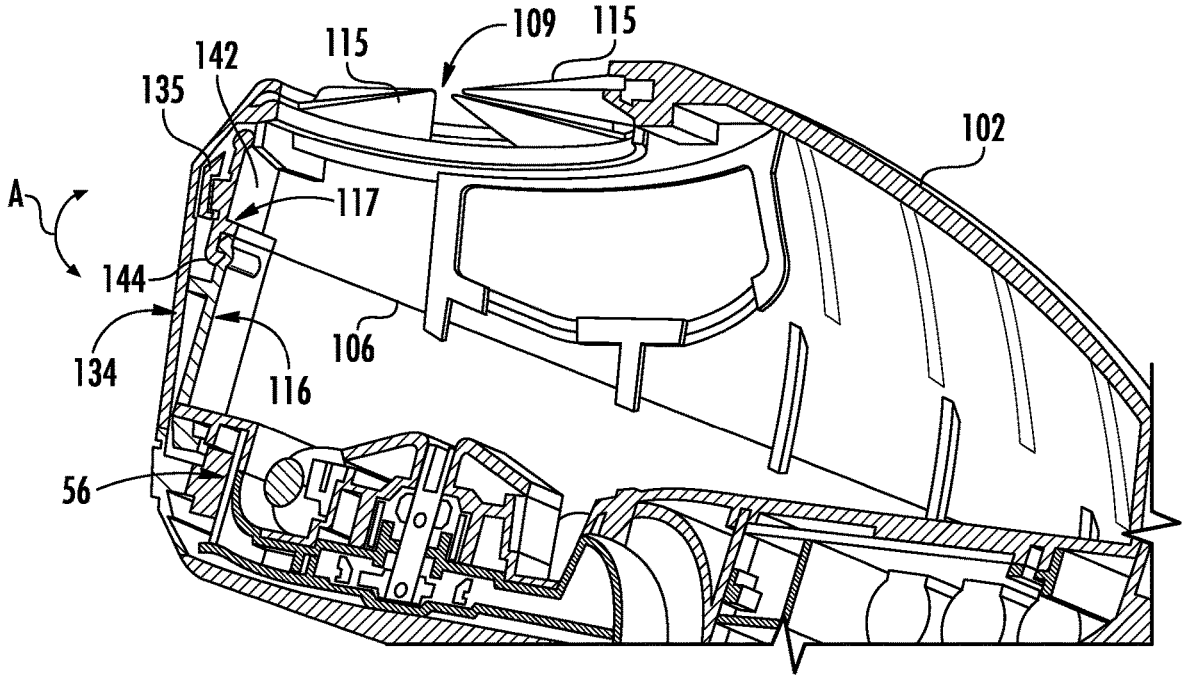
FIG. 7 is a partial side cross-sectional view of the projectile loader according to FIG. 3.
Figure 8:
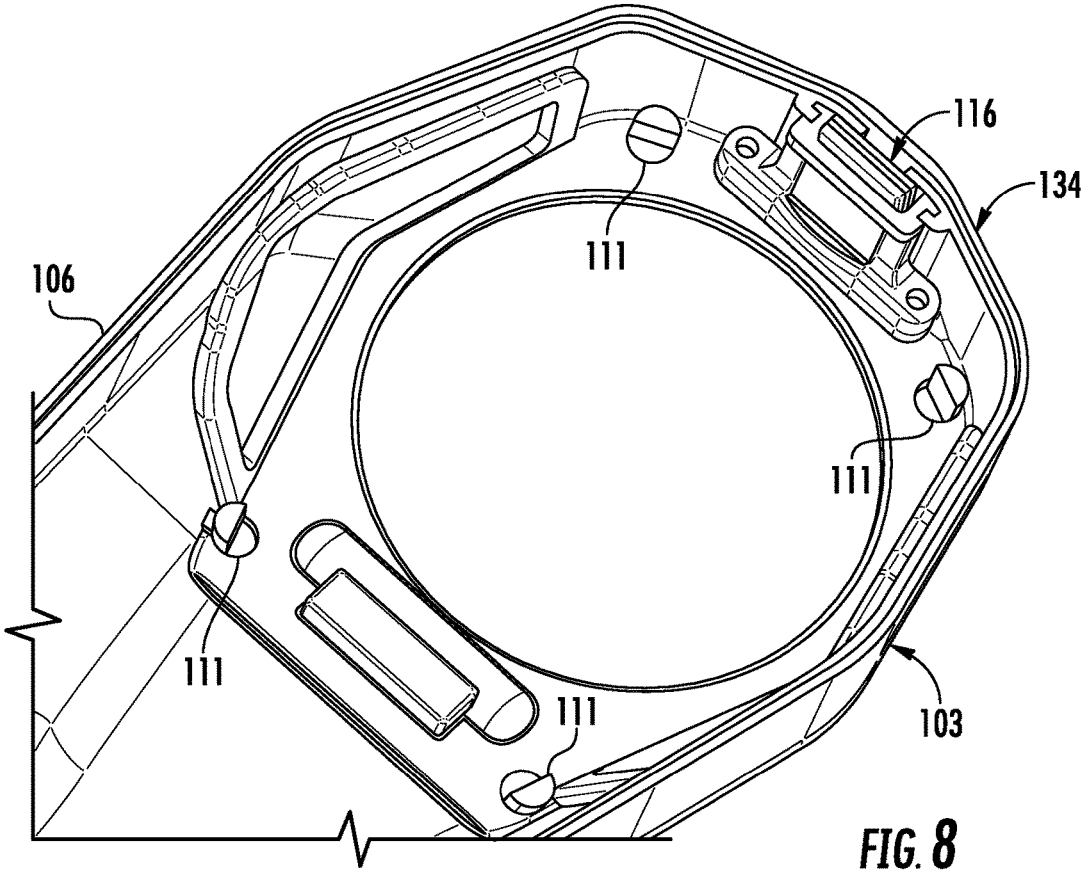
FIG. 8 is a partial top view of a bottom of the projectile loader of FIG. 3 with a first portion of the loader and a feed mechanism both removed.

FIGS. 3-8 show an embodiment of a loader 100 according to the present invention, which includes a body 101 including includes at least a first portion 102 and a second portion 103 with an interior area 138 therebetween. The interior area 138 houses internal components of the loader 100, such as, by way of example, the feed mechanism 56, power supply, or source (e.g., batteries or battery pack), and/or circuitry. As shown in FIG. 8, a plurality of retention elements 111, for example four retention elements, are provided to hold the feed mechanism 56 within the second portion 103 of the loader body, or to otherwise secure or hold components, or permit relative movement of components.

In one aspect, the first portion 102 and the second portion 103 are essentially the same size. As used in this respect, the term "essentially the same size" with respect to the first and second portions means that these two components each define a partially enclosed volume that is within 20-50% of each other.

The body 101, as assembled, preferably has a generally smooth outer surface, or an outer surface having few surface elements or features. For example, a loader body 101 according to the invention may preferably have an outer surface or wall that is free from external features other than a single recess for a power or operation button. This design provides a "sleeker" or "streamlined" silhouette than known designs, with less outer surface features. In addition, a release mechanism, described in greater detail below, is positioned on an inner portion of the body, so that is accessible in an interior of the body. Therefore, the release mechanism is not found on the outer surface of the loader body 101.

Looking directly at the loader 100 from the front or nose portion 132, the first portion 102 may be all or part of a top of the body 101, and the second portion 103 may be all or part of a bottom 136 of the body 101. In the illustrated embodiments, the body 101 is split essentially horizontally along a horizontal plane running generally along the middle of the body 101, and may have an opening at the bottom 136. In this manner, the body 101 opens at the bottom 136 to receive interior components of the projectile loader. In some embodiments, the body 101 is split longitudinally along the length of the body 101, from the nose portion 132 to the back area 134. As such, it is preferable that no split in the body is provided transversely, such as across the width of the body 101. In other embodiments, a split in the body may be provided along a vertical plane, such as in a left/right split arrangement, or the split can follow other paths to separate the body 101.

Figure 5:
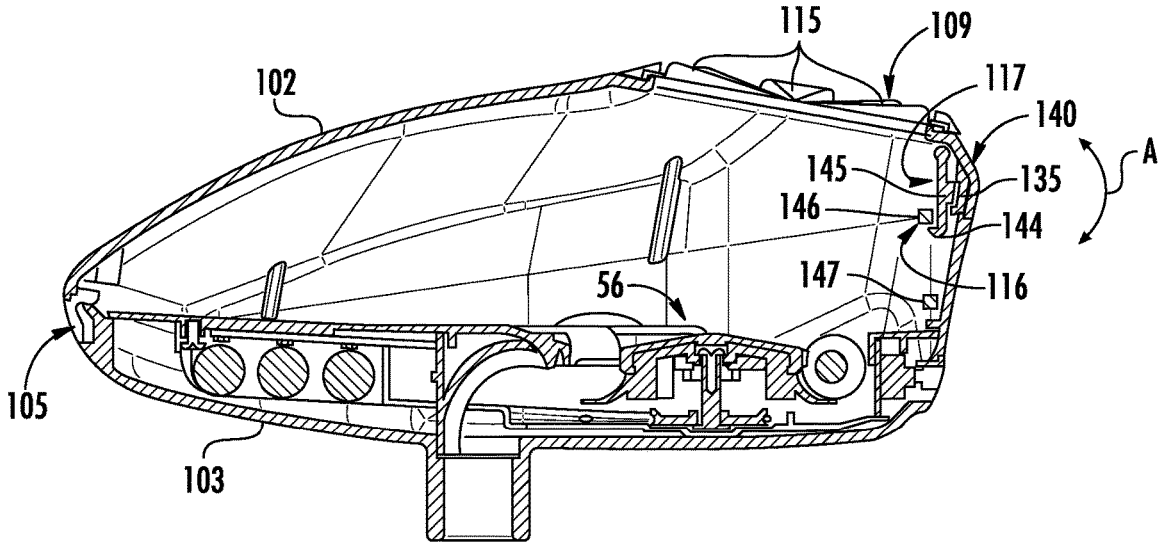
FIG. 5 is a side cross-sectional view of the projectile loader according to FIG. 3.

As shown in FIGS. 5 and 6, a latch 116 on the second portion 103 engages a catch 117 on the first portion 102 to hold the loader body 101 closed. An internal release mechanism 140 actuates the latch 116 and the catch 117 that the body can be opened, and may operate as an attachment and release mechanism. The internal release mechanism 140 is positioned within an interior or adjacent an inner surface of the body. In a preferable embodiment, the release mechanism 140 does not have any portion on the outer surface of the body. The release mechanism 140 is preferably accessed by a user reaching through the opening 109. Generally, a "release mechanism" 140 applicable to the present invention provides a manual actuation to separate the first and second portions 102, 103, and may include various structures that are operable with one hand. The release mechanism 140 may alternatively provide a button, switch, or other device to activate an electromechanical device, a solenoid, or the like for releasing the latch 116 from the catch 117. The release mechanism 140 should preferably be positioned so as to be easily used and accessed without contributing to projectile jams or significantly decreasing the volume of the loader. The release mechanism 140 is preferably positioned completely inside the body 101 so that the body retains its streamlined appearance and so as to prevent accidental actuation.

In the illustrated embodiment, the release mechanism 140 includes the latch 116 mounted on the second portion 103 and the latch 117 mounted on the first portion 102, although the latch and catch may be reversed.

The latch 116 includes a member 146, illustrated here as a horizontally extending bar, for receiving a portion of the catch 117. The latch further includes two legs 148, 150 and a lower member 147. The legs 148, 150 extend away from the second portion 103 and create a space between the member 146 and the back end 134 of the body 101. The latch 116 may be a rigid structure and may be integrally formed with the second portion 103.

The catch 117 is pivotable relative to the first portion 102, by way of flexible or resilient material construction such as plastic, by way of a hinge, or by similar mechanical structure. The catch 117 includes an actuator 142 that may be manipulated to move the catch. As best shown in FIG. 6, the actuator 142 includes a rib 143 and a distal end 144 that are sized and configured to engage the member 146 of the latch 116. As shown in FIG. 7, the distal end 144 and the member 146 can have complementary angled surfaces that aid in closing the loader body 101, particularly by partially pressing the actuator as the angled surfaces slide along one another until the distal end 144 is completely below the member 146.

The actuator 142 may be resiliently biased toward the front portion 132 of the body 101 and the various corners and surfaces of the rib 143 and distal end 144 may be beveled so that the actuator automatically engages the latch 116 when the first portion 102 is closed. To release the first portion, the actuator 142 is moved (i.e., pressed or depressed) toward the rear end 134. Note that the release mechanism 140 may have a push or pull operation. On an opposite side of the catch 117 from the actuator 142 is an extension 145 sized to fit within a recess 135 on the rear end 134 of the loader body 101. When the actuator 142 is depressed, the extension 145 fits within the recess 135 and the recess thereby limits how far the actuator 142 can move.

Depressing, pulling, or otherwise actuating the release mechanism 140 releases the body portions 102, 103 so that they could be separated as shown by the arrow A. The body portions 102, 103 may remain connected by the hinge 105 at the front 132 of the body 101.

In the illustrated embodiment, the release mechanism 140 is positioned only on and proximate the rear end 134 of the loader body 101. Alternatively, the release mechanism 140 may be positioned along the sides or front of the body 101 or portions(s) thereof.

Because the player may not be able to see the release mechanism 140 while operating it, various ergonomic features may be included. In the illustrated embodiment, the release mechanism 140 includes a relatively large and easy to find and utilize actuator 142 that is slightly recessed from the rest of the catch 117. The release mechanism 140, particularly the actuator 142, may also include other ergonomic/detectable features such as a textured surface, a raised rib, a dimple, or the like to aid operation. The illustrated actuator 142 is positioned proximate the opening 109 and the rear portion 134, which allows a user to grab the loader body 101 with some fingers pressing on the rear portion 134 from the outside to provide leverage while one or more fingers (such as a thumb) press the actuator 142, such that the user's hand is effectively making a "squeezing" motion.

In use, pressing the actuator 142 of the release mechanism 140 causes pivoting motion of the catch 117 toward the rear end 134, which moves the rib 143 and the distal end 144 of the catch 117 laterally/horizontally away from the latch 116. As a result, the catch 117 is disengaged from the latch 116 and the first portion 102 is free to separate from the second portion 103. Alternatively, the release mechanism can actuate a solenoid to release the latch 116 from the catch 117.

The release mechanism 140 may have various other additions or modifications. For example, the release mechanism 140 may provide an audible "click" or similar feedback when successfully actuated for release and/or provide an audible "click" when fully closed. The release mechanism 140 may require a two-step actuation motion, or the actuation of two separate buttons, so as to prevent accidental actuation. A spring, such as a torsion spring or a compression spring, may bias the upper body portion 102 to either the open position or the closed position, as desired. In one embodiment, a torsion spring is mounted at coaxially with the hinge 105 to both the first and second portions 102, 103 to bias them toward the open position.

In alternative embodiments, a part of the release mechanism 140 could be configured to be pulled forward toward the front portion 132 to separate the latch 116 from the catch 117. For example, the rib 143 of the catch 117 or the member 146 of the latch 116 could be hinged or resiliently cantilevered to allow such movement, which in turn would allow the loader 100 to open.

The opening 109 of the loader 100 may be a "speed feed" reloader provided with a plurality of fingers 115 extending from the perimeter of the opening to the center of the opening. The fingers 115 may be formed of a resilient material or otherwise spring-mounted, allowing the fingers to deflect when a user reaches and/or loads projectiles and then return to a position extending across the opening 109. In this manner, the fingers 115 function to retain projectiles in the loader 100.

Figure 9:
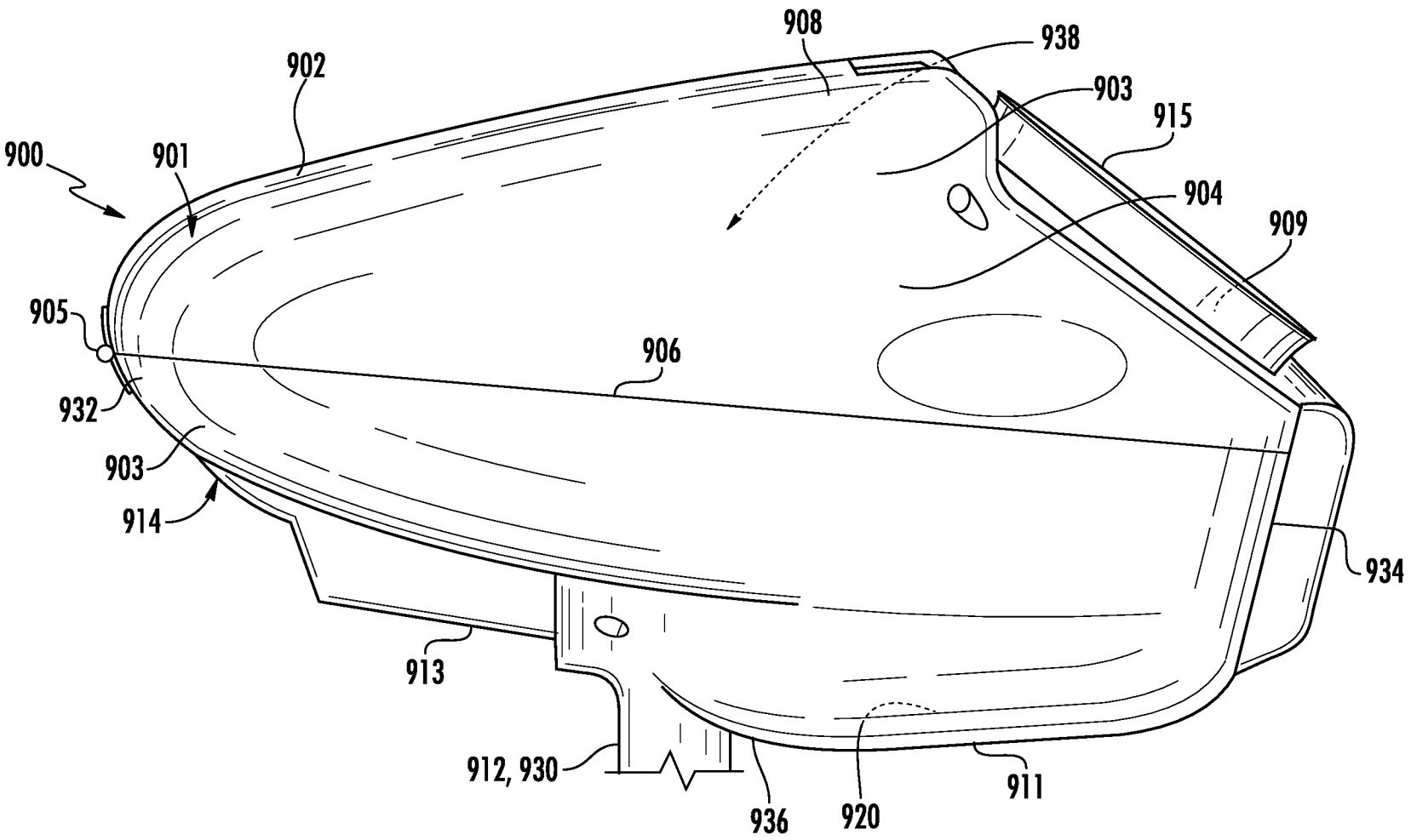
FIG. 9 is a side view of another aspect of a projectile loader having a hinged body according to another embodiment of the present invention.
Figure 10:
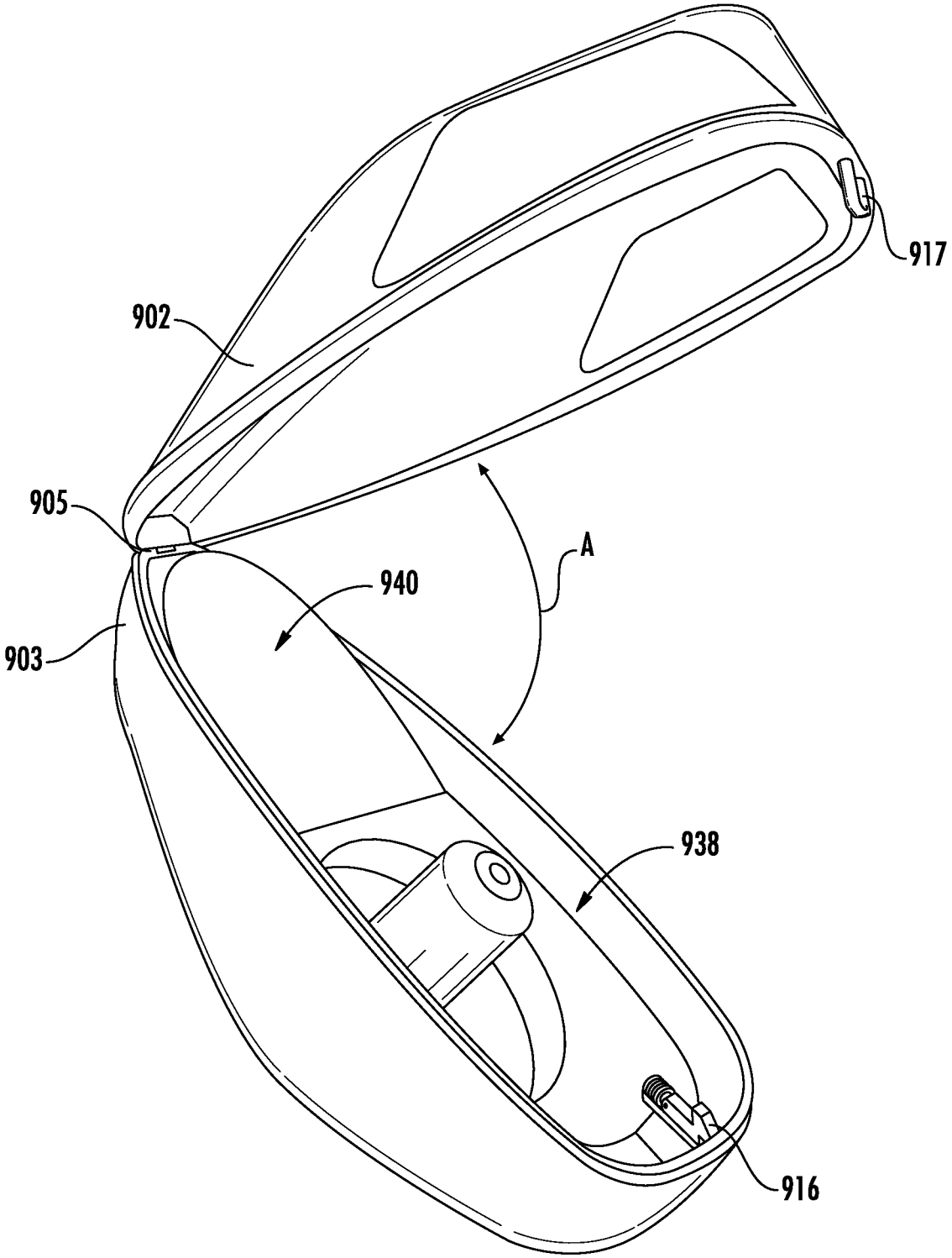
FIG. 10 is a side perspective view of the projectile loader according to FIG. 9 in an open position with the top lifted to expose the internal release mechanism.

As shown in FIGS. 9 and 10, another embodiment of an openable projectile loader 900 according to the present invention is shown with like numerals representing similar parts. The loader 900 includes a body 901 with an interior area 938, which houses internal components as discussed above.

The body 901 includes at least a first portion 902 and a second portion 903 that are split longitudinally. Each of the first portion 902 and second portion 903 include a front or nose portion 932, top wall 908, an opening 909 or mouth area for receiving projectiles, a rear or back area 934, a lower rear wall 911, a feed neck portion 912, and a battery area 913, and a lower front wall 914. The opening 909 may be covered with a lid 915 that is removable, hinged, or otherwise temporarily attached to the body 901. As in the previous embodiment, the first portion 902 and the second portion 903 may be split in various ways and shapes, and may be in varying relative proportions of the overall loader body 901. For example, the second portion 903 may be the majority of the projectile loader body, and the first portion 902 may be a smaller panel that opens, or vice versa. The body 901 has an opening at the bottom 936 to receive interior components of the projectile loader.

The first portion 902 and the second portion 903 are attached by a hinge 905. The hinge is positioned along a division seam 906 between the first portion 902 and the second portion 903 and may be either external (as illustrated) or internal to the loader body 901. The hinge 905 may be any type of hinge, including, for example, but not limited to, a mechanical hinge of any kind, a hinge such as on a door or cabinet, a butt hinge, living hinge, or strap hinge. One or more hinges may be provided. The hinge may be self-closing such as with a spring-biased hinge, or otherwise biased to a closed or open position. The first portion 902 and the second portion 903 move relative to each other as indicated by arrow A in FIG. 13, via the hinge 905. Although the hinge 905 is illustrated proximate a front portion 932 of the body 901, the hinge 905 may alternatively be positioned anywhere along the division seam 906. Thus, a moveable joint or mechanism is provided to allow movement of the first portion 902 and the second portion 903.

FIGS. 9-13 depict a projectile loader body 901 according to the present invention in use with the internal components of a well-known projectile loader, offered under the EMPIRE® and HALO® brand names. The feed mechanism may be similar to that shown in FIG. 2. The body 901 comprises a first portion 902 and a second portion 903, attached by a hinge 905. The hinge 905 is located along the division seam 906 along the front portion 932 of the body 901. As shown in FIG. 6, the first portion 902 and second portion 903 each comprise about half of the projectile loader body, although other relative portions can be used when dividing the body.

Figure 12:
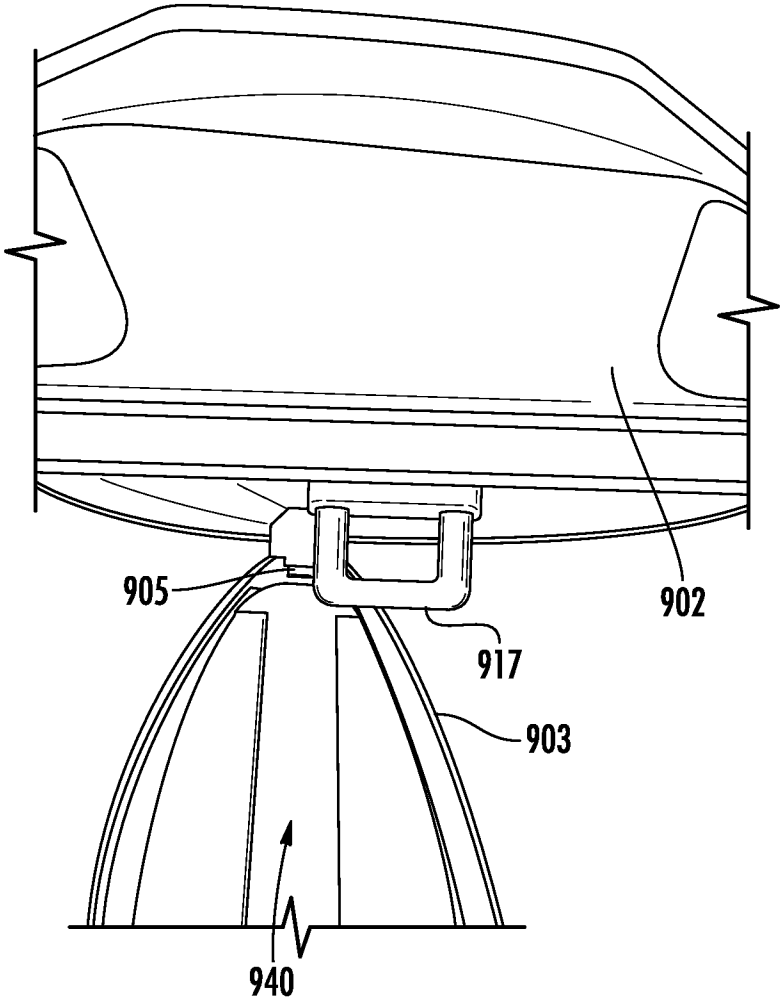
FIG. 12 is another partial top view of the projectile loader according to FIG. 9.
Figure 11:
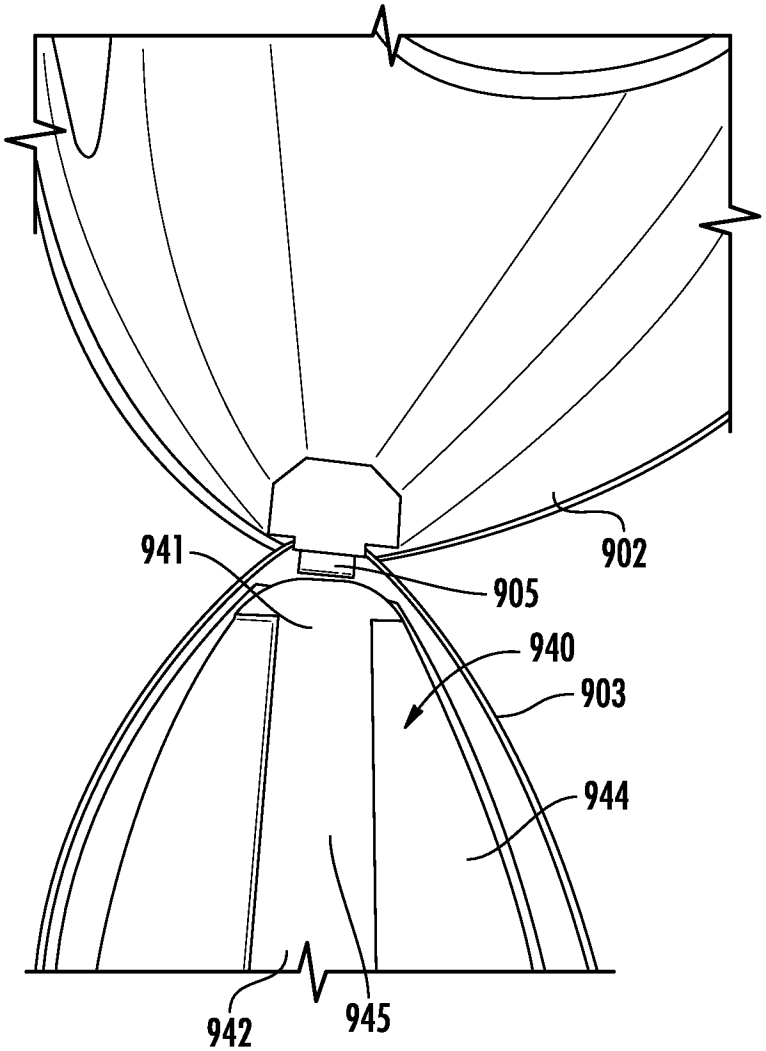
FIG. 11 is a partial top view of the projectile loader according to FIG. 9.

As shown in FIGS. 10 and 12, a latch 916 on the second portion 903 engages a catch 917 on the first portion 902. The latch 916 and catch 917 are manipulated and actuated by a release mechanism 940 that is positioned in a portion of the body to release the two body portions so that the body can be opened, and may operate as an attachment and release mechanism. Generally, a "release mechanism" 940 applicable to the present invention provides a manual actuation to separate the first and second portions 902, 903, and may include, for example, a mechanical linkage, a bowden cable 210 (as further discussed below), an electromechanical device, a solenoid, or the like. As with the embodiment of FIGS. 3-8, the release mechanism 940 is preferably accessed by a user reaching through the opening 909 when the lid 915 is removed/open. The release mechanism 940 should be positioned so as to be easily used without contributing to jams or significantly decreasing the volume of the loader.

Depressing or otherwise actuating the release mechanism 940 releases the body portions 902, 903 by disengaging the latch 916 from the catch 917 so that they could be separated as shown by the arrow A in FIG. 20. The body portions remain connected by the hinge at the front 932 of the body 901.

In the illustrated embodiment of FIGS. 9-13, the release mechanism 940 extends from a proximal end 941 near the hinge 905 to a distal end 202 toward the middle of the loader body 901. As shown, the release mechanism 940 extends along and near the lower front wall 914, but may alternatively be positioned along the sides or rear of the body 901 or portions(s) thereof.

Because the player may not be able to see the release mechanism 940 while operating it, various ergonomic features may be included. In the illustrated embodiment, the release mechanism 940 is an oversized paddle-like lever with a width that increases to complement the shape of the loader body 901. The release mechanism 940 may also include a textured surface 204 and/or a raised rib 205 to guide operation.

Figure 13:
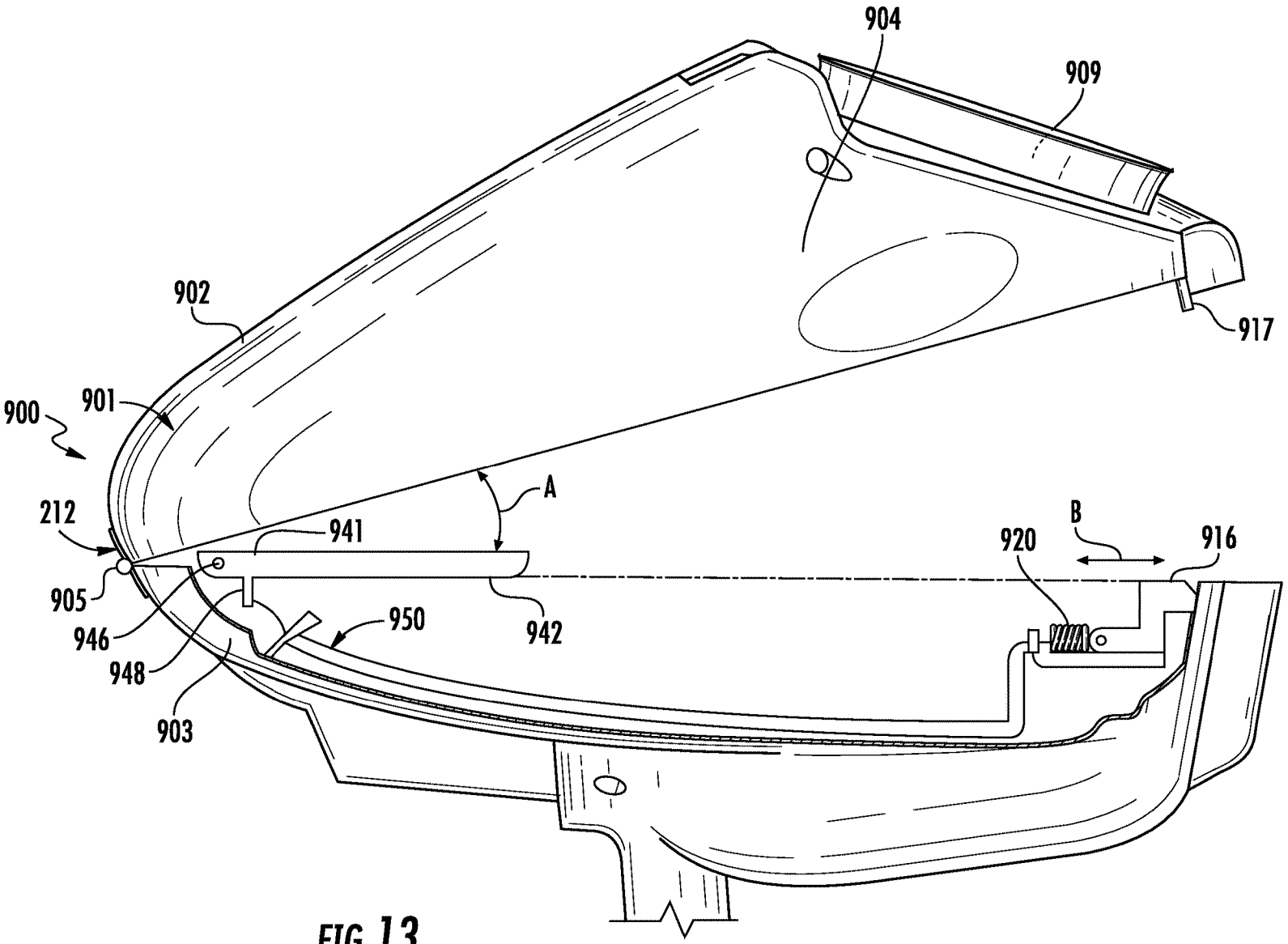
FIG. 13 is a side perspective view of the projectile loader according to FIG. 9, with a portion of the loader removed to show component parts of a release mechanism.

As best shown in FIG. 13, pressing the paddle-like lever (or other actuation) of release mechanism 940 causes pivoting motion about a pivot 946, which rotates a flange 948 away from the catch 917. The flange is operatively connected to a bowden cable 950 or other mechanical linkage to release the latch 916 from the catch 917. The bowden cable can be routed around a side or the lower wall 911, 914 of the body 901 of the projectile loader 900. The latch 916 moves linearly in a direction B in response to the bowden cable 950 and is biased to the closed position by a return spring 920. Alternatively, the release mechanism can actuate a solenoid to release the latch 916 from the catch 917. Various combinations of release mechanisms could also be used.

The release mechanism 940 may have various other additions or modifications. For example, the release mechanism 940 may provide an audible "click" or similar feedback when successfully actuated. The release mechanism 940 may require a two-step actuation motion, or the actuation of two separate buttons, so as to prevent accidental actuation. A spring, such as a torsion spring 952 or a compression spring, may bias the upper body portion 902 to either the open position or the closed position, as desired. In one embodiment, the torsion spring 952 is mounted coaxially with the hinge 905 to both the first and second portions 902, 903 to bias toward the open position.

Figure 14:
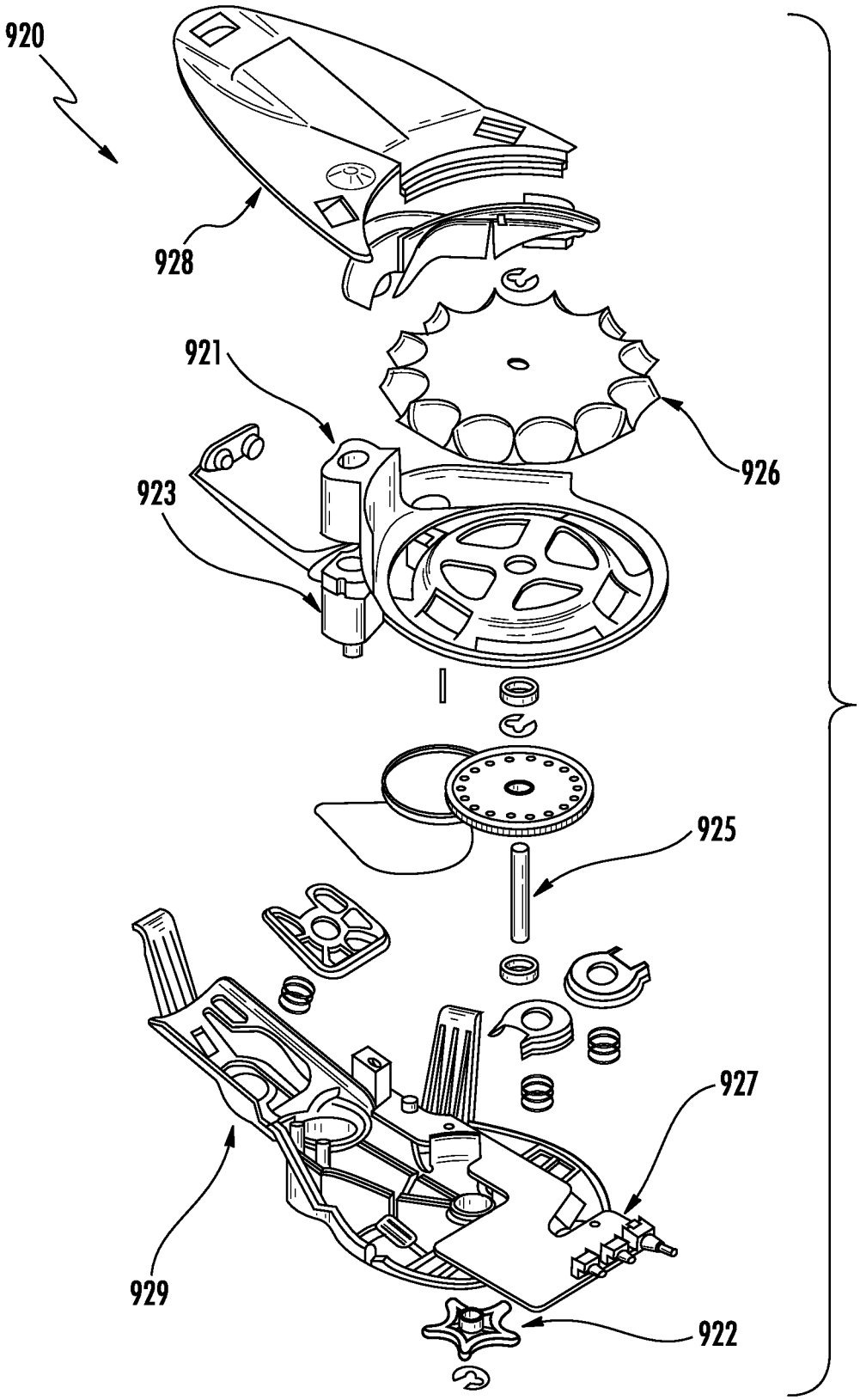
FIG. 14 is an exploded view of component parts of another feed mechanism for use with a hinged projectile loader body of the present invention.

Another feed mechanism 920 applicable to the projectile loader 900 of the present invention is shown in FIG. 14. The feed mechanism 920 includes one or more of the following: a battery holder 921, manual drive assist knob 922, motor 923 with battery harness and battery, drive shaft 925, drive carrier (feeder) 926, circuit board with microprocessor 927, floor 928, back bone, or frame 929 including an outfeed tube or feed neck 930. All of the components are housed on the frame 929 to form an integral feed mechanism assembly 920 which may be removed as a unit. This feed mechanism 920 is applicable to the PROPHECY® or Z2™ brand projectile loaders, among others.

In any of the embodiments discussed above, the first portion 102/902 and second portion 103/903 may be additionally secured to each other via any selected engagement means, such as, by way of example and not by way of limitation, a friction fit, a snapping engagement, complementary interfitted structure, or any other latching mechanism. One portion of the body may have an extension snappingly received in an opening in the other portion of the body. The first portion 902 and second portion 903 may be held together with a removable pin such as a cotter-type pin or a spring biased pin that projects through holes formed in each the portions. Such structure(s) may be positioned at one or multiple areas where the first portion 102/902 engages the second portion 103/903. In other words, the first portion 902 and second portion 903 may have releasable attachments at a plurality of locations along the meeting or facing edges of the body portions. These structures and attachments may be only engaged by a friction or force fit, such that actuation of the release mechanism 140/940 is still sufficient to open the loader body 101/901.

The arrangement of the present invention, having an internally-accessed release mechanism allowing for a simplified exterior, provides advantages over the prior art. The internal components can be readily and fully accessed when the first and second portions are separated. The hinge allows the first and second portions to stay attached when the body is opened. The simplified exterior provides a streamlined look while protecting the release mechanism from dirt, debris, or accidental actuation.

It is understood that this invention is not limited to the particular embodiments disclosed, but is intended to cover all modifications and combinations which are within the spirit and scope of the invention as described herein and/or defined by the appended claims, the above description, and/or shown in the attached drawings.

What is claimed is:

1. A projectile loader, comprising:

a body having an upper portion and opposing first and second ends, and defining an interior area housing internal components;

the body being split into a first portion and a second portion;

the first portion releasably attached to the second portion, the first portion and second portion being moveable relative to each other between an open position and a closed position; and a release mechanism located in the interior area and configured to selectively permit detaching the first portion and the second portion when an actuator of the release mechanism is moved outwardly toward an inner wall of the body, wherein the actuator of the release mechanism is located completely within the interior area of the body; and an opening for loading projectiles into the projectile loader, wherein the actuator of the release mechanism is only accessible via the opening.

2. The projectile loader of claim 1, wherein the release mechanism and the opening are both located proximate to the second end of the body.

3. The projectile loader of claim 1, wherein the release mechanism is located proximate to the first end of the body and the opening is located proximate to the second end of the body.

4. The projectile loader of claim 1, wherein the first portion and the second portion are attached via a hinge, and wherein the release mechanism is located proximate to the hinge.

5. The projectile loader of claim 4, wherein the hinge is spring-biased to an open position.

6. The projectile loader of claim 4, wherein the hinge is spring-biased to a closed position.

7. The projectile loader of claim 1, wherein the release mechanism is configured for one-handed actuation.

8. The projectile loader of claim 1, wherein the first portion and the second portion are essentially a same size.

9. The projectile loader of claim 1, further comprising a moveable feeder housed within the interior area of the projectile loader body.

10. The projectile loader of claim 1, further comprising a feed mechanism comprising a moveable feeder and a motor housed within the interior of the projectile loader body, the feed mechanism configured to be at least partially removable from the projectile loader body when the body is in the open position.

11. The projectile loader of claim 1, wherein the body is split generally vertically along a length of the body such that the first and second portions are respectively a first side portion and a second side portion.

12. A projectile loader, comprising:

a body having an upper portion and opposing first and second ends, and defining an interior area housing internal components;

the body being split into a first portion and a second portion;

the first portion releasably attached to the second portion, the first portion and second portion being moveable relative to each other between an open position and a closed position; and a release mechanism located in the interior area and configured to selectively permit detaching the first portion and the second portion when an actuator of the release mechanism is moved outwardly toward an inner wall of the body, wherein the actuator of the release mechanism is located completely within the interior area of the body; and a moveable feeder housed within the interior of the projectile loader body.

13. The projectile loader of claim 12, wherein the first end comprises a front portion of the projectile loader body, and wherein the second end comprises a rear end of the projectile loader body.

14. The projectile loader of claim 13, wherein the release mechanism and an opening for loading projectiles into the projectile loader are both located proximate to the second end of the body.

15. A projectile loader, comprising:

a body having an upper portion and opposing first and second ends, and defining an interior area housing internal components;

the body being split into a first portion and a second portion;

the first portion releasably attached to the second portion, the first portion and second portion being moveable relative to each other between an open position and a closed position; and a release mechanism located in the interior area and configured to selectively permit detaching the first portion and the second portion when an actuator of the release mechanism is moved outwardly toward an inner wall of the body, wherein the actuator of the release mechanism is located completely within the interior area of the body; and a feed mechanism comprising a moveable feeder and a motor housed within the interior of the projectile loader body, the feed mechanism configured to be at least partially removable from the projectile loader body when body is in the open position.

16. The projectile loader of claim 15, wherein the first end comprises a front portion of the projectile loader body, and wherein the second end comprises a rear end of the projectile loader body.

17. The projectile loader of claim 16, wherein the release mechanism and an opening for loading projectiles into the projectile loader are both located proximate to the second end of the body.

18. A projectile loader, comprising:

a body having an upper portion and opposing first and second ends, and defining an interior area housing internal components;

the body being split into a first portion and a second portion;

the first portion releasably attached to the second portion, the first portion and second portion being moveable relative to each other between an open position and a closed position; and a release mechanism located in the interior area and configured to selectively permit detaching the first portion and the second portion when an actuator of the release mechanism is moved outwardly toward an inner wall of the body, wherein the actuator of the release mechanism is located completely within the interior area of the body;

wherein the body is split generally vertically along a length of the body such that the first and second portions are respectively a first side portion and a second side portion.

19. The projectile loader of claim 18, wherein the first end comprises a front portion of the projectile loader body, and wherein the second end comprises a rear end of the projectile loader body.

* * * * *